US006295720B1

(12) United States Patent
Finn et al.

(10) Patent No.: US 6,295,720 B1
(45) Date of Patent: Oct. 2, 2001

(54) DEVICE FOR PRODUCING A COIL ARRANGEMENT

(76) Inventors: David Finn, Steinmühlenweg 16a, DE-87629 Füssen-Weissensee; Manfred Rietzler, Am Alsterberg 10, DE-87616 Marktoberdorf, both of (DE)

( * ) Notice: Subject to any disclaimer, the term of this patent is extended or adjusted under 35 U.S.C. 154(b) by 0 days.

(21) Appl. No.: 09/254,247

(22) PCT Filed: Aug. 12, 1997

(86) PCT No.: PCT/DE97/01712

§ 371 Date: Feb. 26, 1999

§ 102(e) Date: Feb. 26, 1999

(87) PCT Pub. No.: WO98/09305

PCT Pub. Date: Mar. 5, 1998

(30) Foreign Application Priority Data

Aug. 28, 1996 (DE) ..... 196 34 661

(51) Int. Cl.[7] ..... H01F 41/02

(52) U.S. Cl. ..... 29/605; 29/850; 140/92.1; 140/92.2

(58) Field of Search ..... 29/605, 850; 140/92.1, 140/92.2; 242/439, 439.4

(56) References Cited

U.S. PATENT DOCUMENTS 1,944,870 1/1934 Apple .

FOREIGN PATENT DOCUMENTS 537 086 6/1973 (CH) .
43 07 064 A1 9/1994 (DE) .
43 32 055 A1 3/1995 (DE) .
44 08 124 A1 9/1995 (DE) .
WO 91/16718 10/1991 (WO) .
WO 92/15105 9/1992 (WO) .

*Primary Examiner*—Carl E. Hall
(74) *Attorney, Agent, or Firm*—McGlew & Tuttle, P.C.

(57) ABSTRACT

Method for manufacturing a coil arrangement with a plurality of winding wire regions (54, 55, 56) constructed in superimposed winding wire planes in a winding tool (28) with the following method steps:

fixing of the winding wire (53) in a first wire holding device (39) at the circumferential edge of a basic matrix (21), rotation of the winding tool (28) so as to lay the winding wire (53) against an additional matrix (36) arranged on the basic matrix (21) of the winding tool (28) and formation of a first winding wire region (55) arranged on the surface (26) of the basic matrix, closure of the winding tool (28) by displacing a brace (48) towards the matrix surface (26) of the basic matrix (21) and rotation of the winding tool (28) so as to lay the winding wire (53) on the winding circumference (24) of the basic matrix (21) and formation of a further winding wire region as coil element (54), fixing of the coil element (54) and rotation of the winding tool (28) with brace (48) at a distance from the matrix surface (26) of the basic matrix (21) so as to lay the winding wire (53) against the additional matrix (36) and formation of a further winding wire region (56) arranged above the coil element (54), fixing of the winding wire (53) in a second wire holding device (40) at the circumferential edge of the basic matrix (21).

17 Claims, 6 Drawing Sheets

45
44
28
46
20
42
21
22
41
25
24
47
26
23
27
43
62
51
23
51
50
49
35
31
37
38
33
32
34
72
30
29
22
71

DEVICE FOR PRODUCING A COIL ARRANGEMENT

The present invention relates to a method for manufacturing a coil arrangement according to claim 1, and a device for carrying out a method of this type according to the preamble of claim 5.

In order to manufacture coil arrangements having a plurality of differently constructed coils or coils with different orientations, it has been customary to date to manufacture the coils individually and then to contact them with one another in a subsequent manufacturing process, resulting in the desired coil arrangement. This method proves to be complex, not least owing to the difficult handling of the extremely thin winding wire ends of the coils during the contacting. In addition, different winding tools need to be used for differently dimensioned coils in order to manufacture the individual coils.

It is therefore the object of the present invention to propose a method and a device, by means of which the manufacture of coil arrangements of the above type can be simplified.

This object is attained by a method having the features of claim 1 and a device having the features of claim 5.

The method according to the invention allows for the manufacture of a coil arrangement with a plurality of winding wire regions constructed in superimposed winding wire planes in a winding tool with the following method steps:

fixing of the winding wire in a first wire holding device at the circumferential edge of a basic matrix, rotation of the winding tool with a brace at a distance from the basic matrix so as to lay the winding wire against an additional matrix arranged on the basic matrix and formation of a first winding wire region arranged on the surface of the basic matrix, closure of the winding tool by displacing the brace towards the surface of the basic matrix and rotation of the winding tool so as to lay the winding wire on the winding circumference of the basic matrix and formation of a further winding wire region as coil element, fixing of the coil element and rotation of the winding tool with brace at a distance from the matrix surface of the basic matrix so as to lay the winding wire against the additional matrix and formation of a further winding wire region arranged above the coil element, and fixing of the winding wire in a second wire holding device at the circumferential edge of the basic matrix.

Depending on the shape or number of windings of the further winding wire region, this can be formed as a connecting wire region for contacting the first coil element or even as a further coil element directly connected to the first coil element.

In a particularly advantageous variant of the method according to the invention, the first winding wire region formed against the additional matrix and the second winding wire region formed against the additional matrix are guided over connecting surfaces of a chip unit arranged on the surface of the basic matrix and a contacting of the winding wire regions with the connecting surfaces of the chip unit is then effected.

In this variant of the method, the winding wire regions defined in their path by the additional matrix are used to form coil wire ends prepared in their orientation for contacting with connecting surfaces of a chip unit. Consequently, a contacting of the coil wire ends with the connecting surfaces of a chip unit is advantageously possible in the winding tool, without having to position the chip unit as a function of the orientation of the coil wire ends.

It has proved particularly advantageous in this context if, prior to forming the first winding wire end region between two matrix elements of the additional matrix arranged on the basic matrix, the chip unit is fitted into a holding device of the basic matrix.

If, following the contacting, a cutting of winding wire ends formed in the region between the wire holding devices and the additional matrix is effected in each case at two cutting points in the region between the connecting surfaces of the chip unit and the wire holding devices, it is possible to already effect the removal of excess wire regions, i.e. winding wire ends of the coil arrangement projecting beyond the connecting surfaces of the chip unit, in the winding tool per se, so that a subsequent, separate handling of the coil arrangement to this end can be dispensed with.

The winding tool according to the invention for manufacturing a coil arrangement formed in the above manner and fashion comprises a matrix arranged on a matrix support and a holding arrangement arranged at the circumference of the matrix on the matrix support with at least two holding devices for holding winding wire end regions and a brace arranged opposite the matrix support and adjacent the matrix, the matrix being constructed as a basic matrix, and with an additional matrix arranged on the basic matrix, and the brace being variable in its arrangement relative to the basic matrix.

This relative arrangement of the basic matrix and additional matrix allows for the type of method for manufacturing a coil arrangement as explained in detail above.

In a particularly advantageous embodiment of the winding tool, the additional matrix comprises at least two matrix elements, which are arranged either side of a holding device arranged on the basic matrix for the positioning accommodation of a chip unit, the matrix elements being arranged and constructed in such a manner that winding wire regions extending along a winding circumference of the additional matrix defined by the matrix elements comprise an overlap position with connecting surfaces of a chip unit arranged in the holding device.

Constructed in this manner, the winding tool can be used to manufacture a coil arrangement comprising a coil element formed on the basic matrix and a chip unit, the additional matrix being used to form winding wire regions which are precisely defined in their orientation and which allow for a direct contacting of the coil element wound in the winding tool with the chip unit.

In a particularly simple embodiment, the matrix elements of the additional matrix are constructed as cylinder rods.

If a wire deflecting device is arranged adjacent a matrix element of the additional matrix in such a manner that the intermediate space between the matrix element and the wire deflecting device forms an engagement space for a wire gripping device, excess wire ends can be removed from the winding tool in a simple manner.

A variant of the method according to the invention and a embodiment of a winding tool particularly suitable for carrying out this method variant will be explained in further detail in the following with the aid of the drawings, in which.

Figure 1:
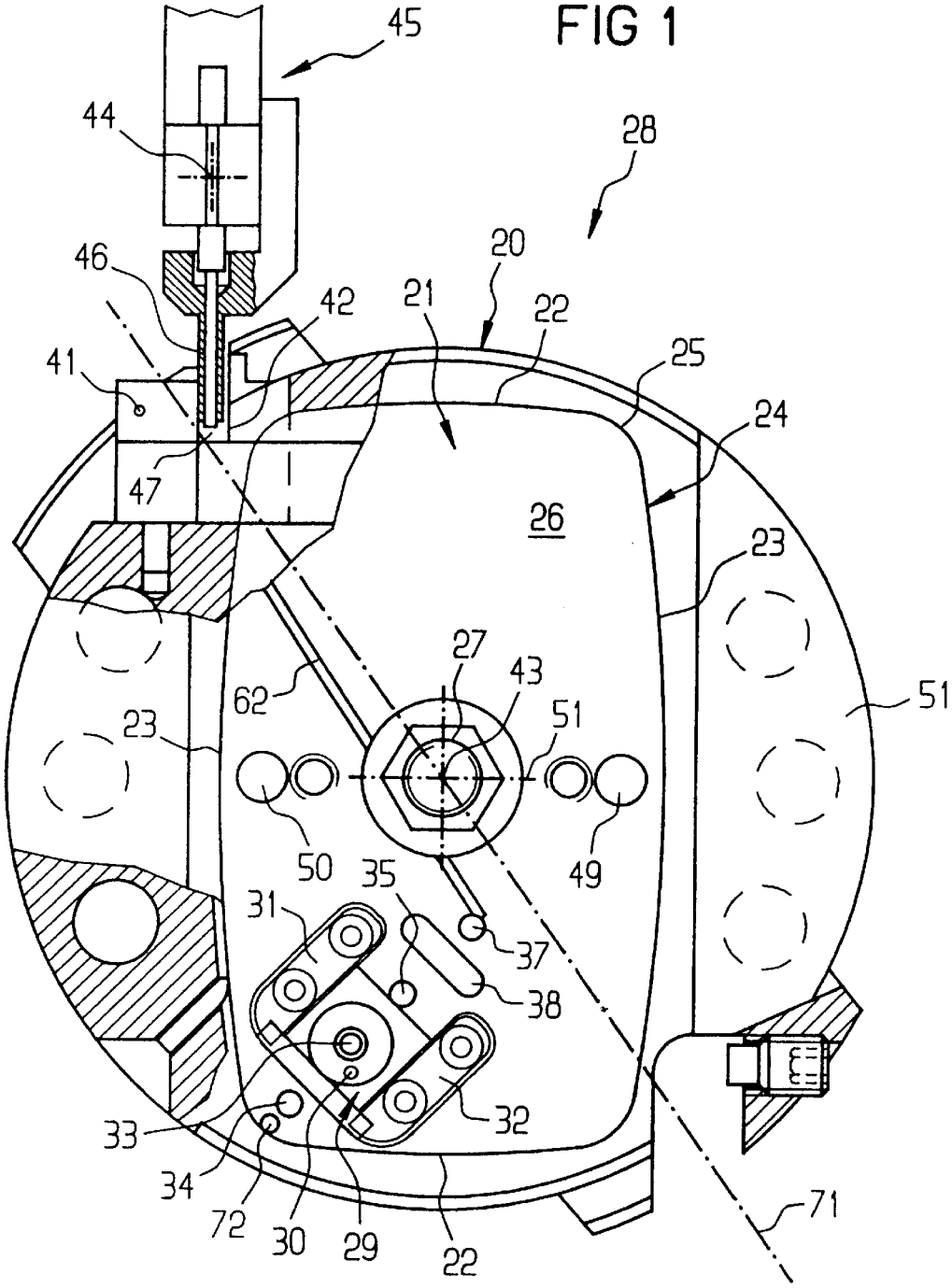
FIG. 1 is a plan view of a basic matrix arranged on a matrix support of a winding tool.

FIG. 1 is a plan view of a winding tool 28 with a basic matrix 21 arranged on a matrix support 20, which is essentially circular disk-shaped in this case, with a winding circumference 24 composed of four circumferential lateral surfaces 22 and 23, the circumferential lateral surfaces 22 and 23 being convex and being connected to one another by rounded transition regions 25. The basic matrix 21 comprises a flat matrix surface 26, in which a connecting bolt 27 is recessed for the non-rotatable connection of the matrix support 20 with a rotary drive, not shown in further detail, for driving the winding tool 28.

Accommodated in the matrix surface 26 of the basic matrix 21 is a holding device 29 for the positioning arrangement of a chip unit, not shown in further detail in FIG. 1. The holding device 29 comprises a permanent magnet 30, which is disk-shaped in this case, and two positioning jaws 31, 32, the positioning jaw 31 being adjustable parallel to the positioning jaw 32. An ejector mandrel 33 is disposed in a centrally arranged aperture in the permanent magnet 30.

Arranged in raised fashion on the matrix surface 26 of the basic matrix 21 are two matrix elements, which are constructed in this case as cylinder rods 34 and 35 and together form an additional matrix 36 arranged on the surface of the basic matrix 21.

Arranged adjacent the cylinder rod 35 is a deflector rod 37, also constructed as a cylinder rod. Between the cylinder rod 35 and the deflector rod 37, the matrix surface 26 comprises a gripping aperture 38, constructed here as a slot. A further deflector rod 72 is arranged in alignment with the cylinder rods 34 and 35 and the deflector rod 37 and is arranged adjacent the circumferential region 25 at the outer edge of the matrix surface 26.

The matrix support 20 is provided at its circumferential edge with two wire holding devices 39, 40, in this case arranged on a central diagonal 71. The wire holding devices 39, 40 are identical in construction and each comprises a clamping jaw 41, which is movable relative to a clamping base 42, the movement of the clamping jaw 41 being effected transversely to the axis of rotation 43 of the winding tool 28 in this case. As is clear from FIG. 1 in the example of the wire holding device 39 arranged at the top left, the clamping jaw 41 is actuated by means of a wire guide 45, which is displaceable on a translation axis 44 extending parallel to the axis of rotation 43 of the winding tool 28. To this end, a wire guide 46, by means of which a winding wire not shown in further detail here is drawn from a supply device, also not shown in further detail, is guided past the clamping jaw 41, overcoming restoring forces, and through a clamping gap 47. As a result of the closure of the clamping gap 47 following the passage of the wire guide capillary 46, the winding wire is then clamped by the clamping jaw 41 against the clamping base 42.

Figure 2:
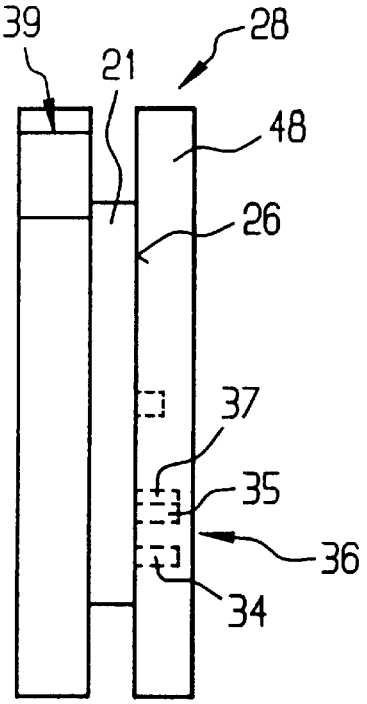
FIG. 2 is a schematic side view of the winding tool illustrated in FIG. 1 with a brace fitted onto the basic matrix.
Figure 3:
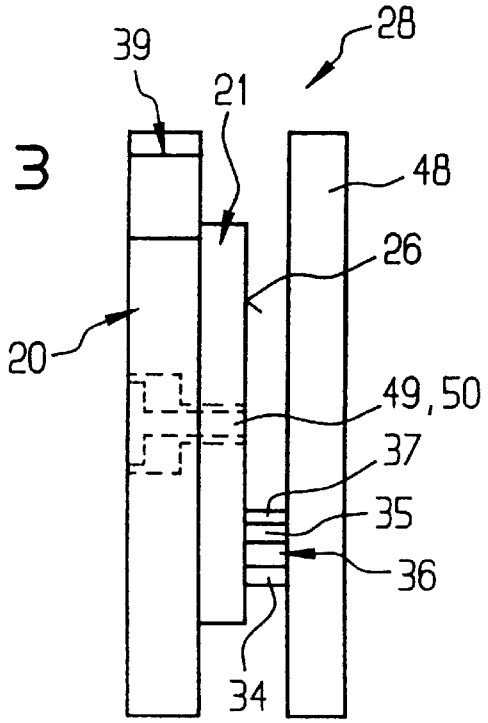
FIG. 3 is an illustration of the winding tool corresponding to the view of FIG. 2 with the brace at a distance from the basic matrix.

FIGS. 2 and 3 show the winding tool 28 provided with a brace 48, in FIG. 2 the brace 48 being moved towards the matrix surface 26 of the basic matrix 21 and in FIG. 3 the brace 48 lying at a distance from the matrix surface 26 of the basic matrix 21.

From the illustration according to FIG. 2 with the brace 48 moved towards the matrix surface 26 of the basic matrix 21, it is clear that the cylinder rods 34 and 35 of the additional matrix 36 and the deflector rod 37 engage in receiving apertures correspondingly constructed in the brace 48 and not shown in further detail here. Furthermore, as is clear from FIG. 1, two cylindrical driving rods 49 and 50 (FIG. 1) are arranged on the matrix surface 26 of the basic matrix 21, which also engage in receiving apertures, not shown in further detail in FIG. 2, provided to this end in the brace 48. As shown in FIG. 1, the driving rods 49 and 50 are arranged on a central point axis 51 intersecting the axis of rotation 43 and allow the brace 48 to be rotatably driven when the matrix support 20 rotates.

As shown in FIG. 3, the driving rods 49, 50 are constructed in such a manner that they can be recessed in the matrix surface 26 of the basic matrix 21, so that in the open configuration of the winding tool 28 shown in FIG. 3, only the cylinder rods 34, 35 and the deflector rod 37 project beyond the matrix surface 26 of the basic matrix 21.

Figure 10:
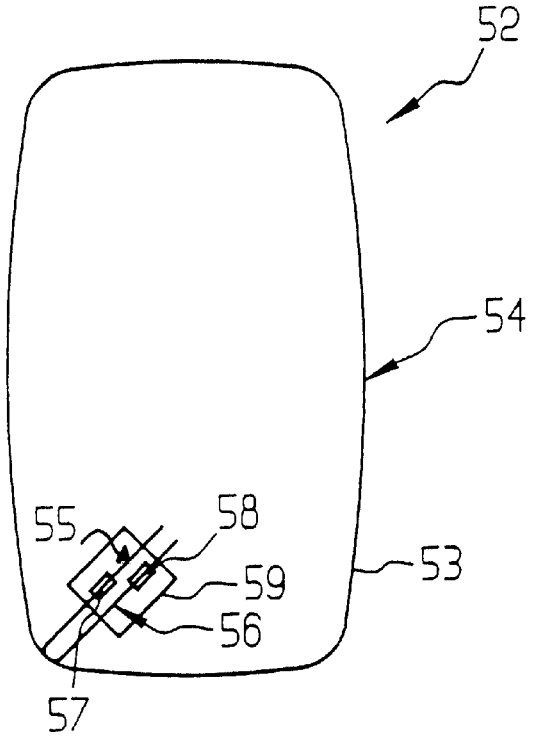
FIG. 10 shows a first coil arrangement manufactured on the winding tool according to FIG. 1.

The use of the winding tool 28 explained above in its component parts with reference to FIGS. 1 to 3 for manufacturing a coil arrangement 52, as illustrated in FIG. 10, will be explained in the following. As is clear from FIG. 10, the coil arrangement 52 comprises a coil element 54 wound from winding wire 53, whose winding wire ends, which in addition to the coil element 54 form further winding wire regions 55 and 56, are contacted with connecting surfaces 57, 58 of a chip unit 59.

Figure 4:
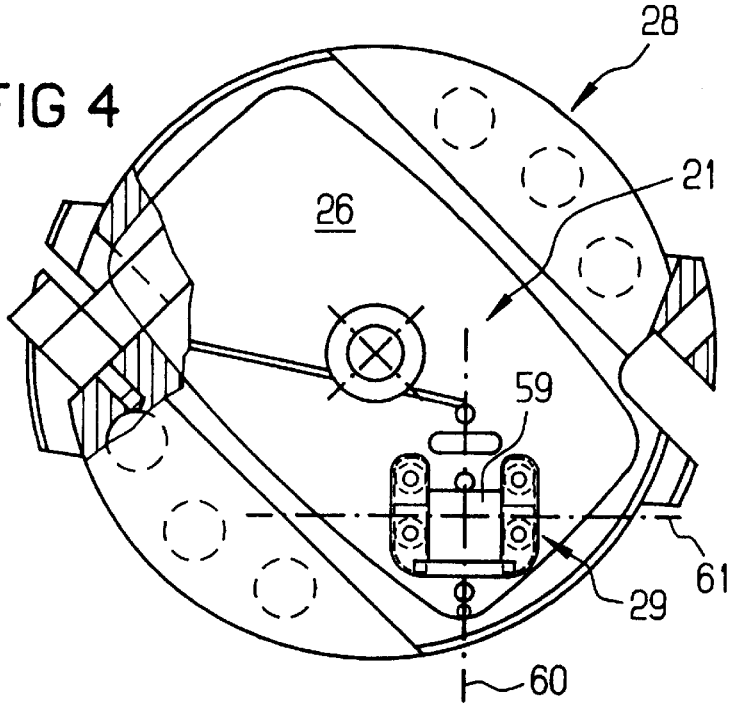
FIG. 4 shows the winding tool illustrated in FIG. 1 in a fitting position.

FIG. 4 shows the winding tool 28 in a fitting position, in which the brace 48 (FIGS. 2 and 3) lies at a distance from the basic matrix 21 and the matrix surface 26 is axially freely accessible. In this position, the chip unit 59 is fitted into the holding device 29, the positioning jaws 31, 32 firstly being moved apart and the chip unit 59 being held solely by the magnetics force of the permanent magnet 30. In this respect, the magnetic forces act between the metallised connecting surfaces of the chip unit 59, which can comprise nickel, for example, and the permanent magnet 30. For positioning on a positioning axis 61 of the holding device 29 extending perpendicular to a longitudinal extension axis 60 of the additional matrix 36, the positioning jaws 31 and 32 are then moved towards one another. This results in a precise alignment on the positioning axis 61. The precise alignment of the chip unit 59 on the longitudinal extension axis 60 can be dispensed with, as will be explained in further detail with reference to FIG. 9.

Figure 5:
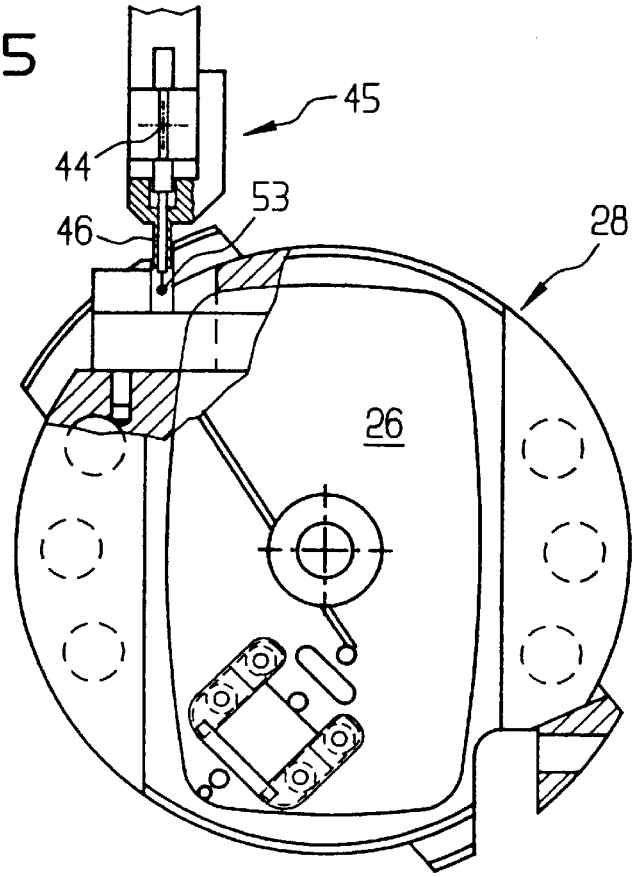
FIG. 5 shows the winding tool illustrated in FIG. 1 in a first wire fixing position.

FIG. 5 shows the winding tool 28 in a first wire fixing position, in which the wire guide 45 together with the winding wire 53 drawn from the wire guide capillary 46 is moved along the translation axis by the wire holding device 39. After moving the wire guide capillary 46 through the clamping gap 47, the winding wire 53 is held by clamping in the wire holding device 39. During the subsequent winding process, the wire guide remains in a position upstream of the wire holding device 39, so that the winding wire secured in the wire holding device 39 is continuously withdrawn from the wire guide 45 as the winding tool 28 rotates.

Figure 6:
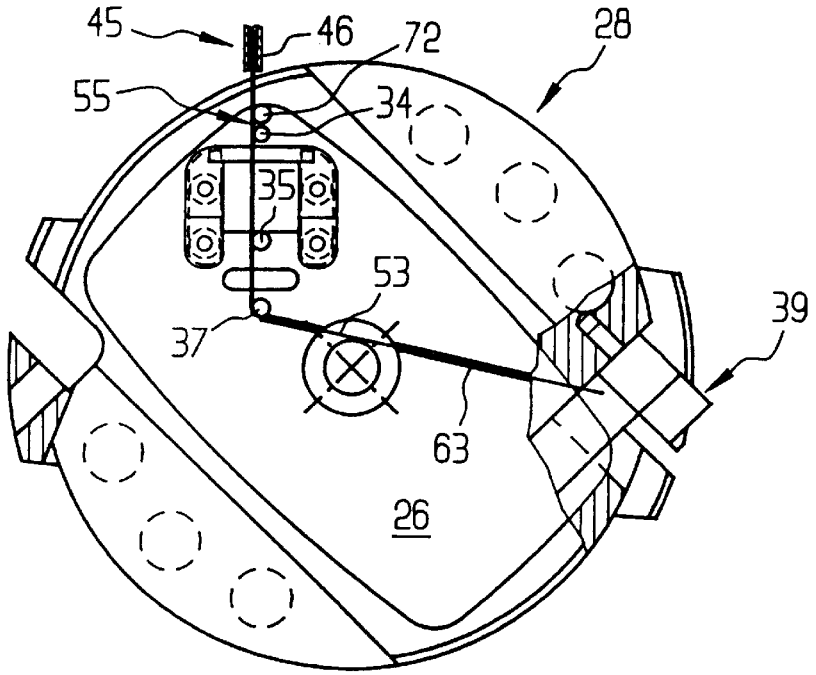
FIG. 6 shows the winding tool illustrated in FIG. 1 in a closed position with a first winding wire region laid against an additional matrix.

FIG. 6 shows the winding tool 28 in a closed position rotated in an anticlockwise direction through approximately 270° relative to the first wire fixing position illustrated in FIG. 5. In this position, a first winding wire region 55 is laid—on the left side according to FIG. 6—against the cylinder rods 34 and 35 of the additional matrix 36 and against the deflector rod 37, so that the wire configuration illustrated in FIG. 6 is formed. A winding wire end 63 extending in a wire duct 62 (FIG. 1) transversely over the matrix surface 26 of the basic matrix 21 extends from the deflector rod 37 to the wire holding device 39.

When the wire configuration illustrated in FIG. 6 has been formed, the winding tool 28 is then closed by displacing the brace 48 towards the matrix surface 26 of the basic matrix 21. Insodoing, the cylinder rods 34, 35 and the deflector rod 37 and the previously recessed and now projecting driving rods 49, 50 penetrate the brace 48, as illustrated in FIG. 2.

Figure 7:
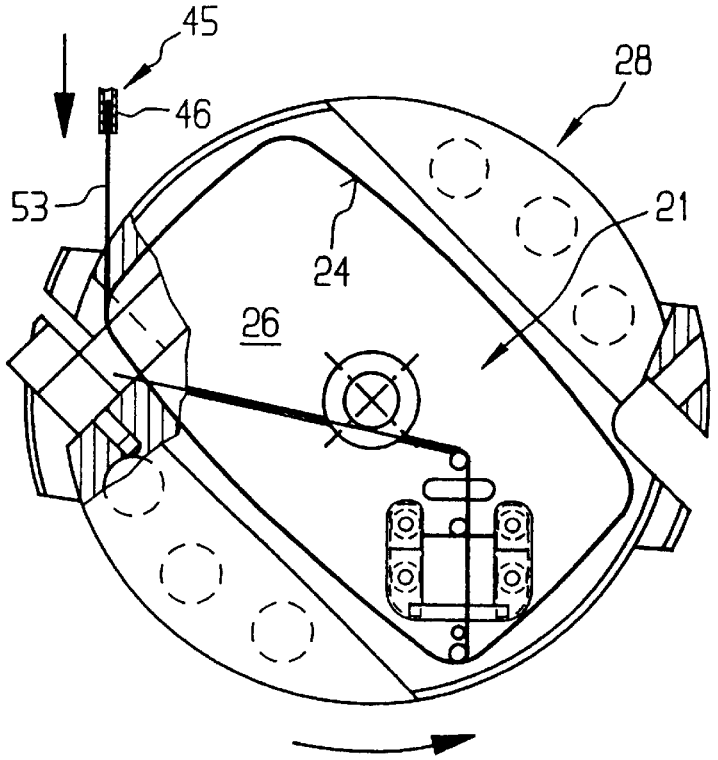
FIG. 7 shows the winding tool illustrated in FIG. 1 during the winding of a coil element on the basic matrix.

Following closure of the winding tool 28, the winding of the coil element 54 on the winding circumference 24 of the basic matrix 21 is effected, as illustrated in FIG. 7, the winding wire 53 being continuously withdrawn from the wire guide capillary 46 of the wire guide 45. In this respect, the position of the winding wire transition from the matrix surface 26 (FIG. 6) to the winding circumference 24 is defined by the deflector rod 72.

Figure 8:
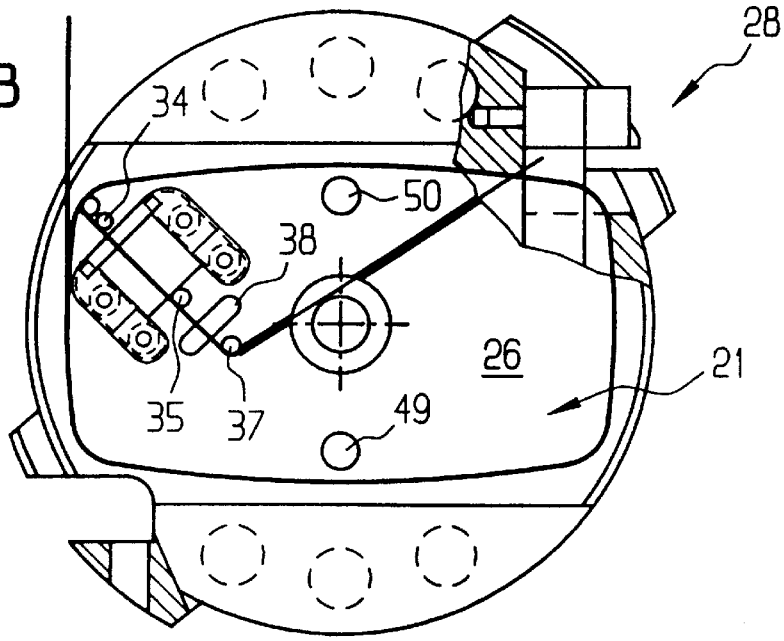
FIG. 8 shows the winding tool illustrated in FIG. 1 in an open position.
Figure 9:
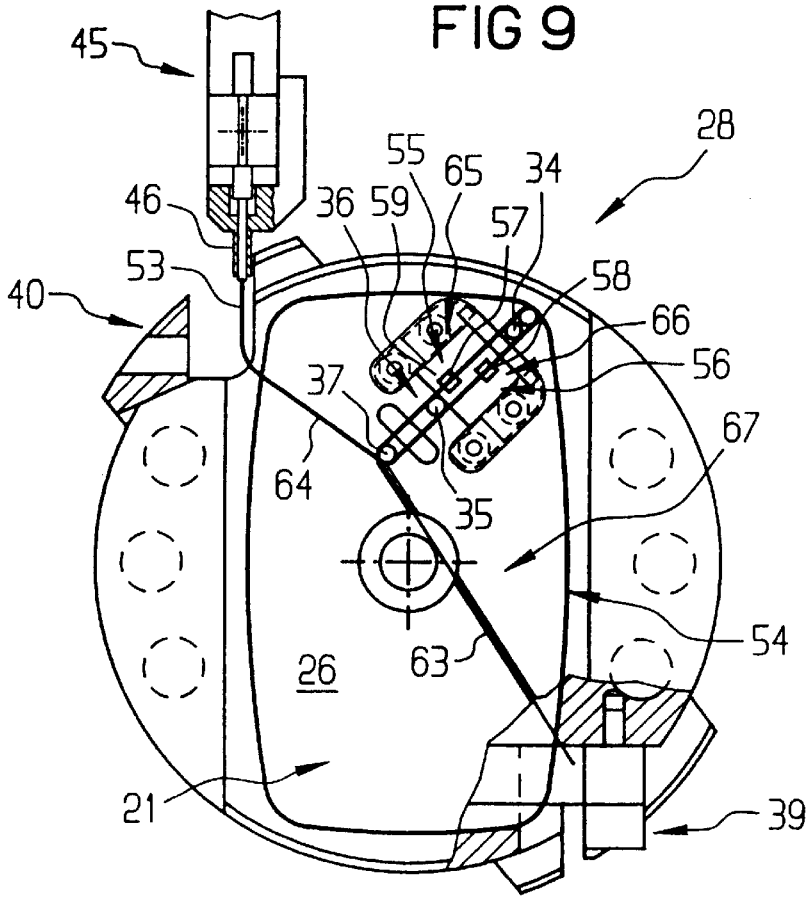
FIG. 9 shows the winding tool illustrated in FIG. 1 in a second wire fixing position.

FIG. 8 shows the winding tool 28 in an open position, in which the brace 48, as illustrated in FIG. 3, is moved away from the matrix surface 26 of the basic matrix 21, releasing the cylinder rods 34, 35 of the additional matrix 36 and the deflector rod 37. In addition, the driving rods 49, 50 are recessed into the matrix surface 26 of the basic matrix 21, as also illustrated in FIG. 3. With the subsequent continuation of the winding process through approximately 270°, the winding tool 28 is transferred into the second wire fixing position illustrated in FIG. 9. In this case, the winding wire region 56 is laid opposite the winding wire region 55 against the cylinder rods 34, 35 of the additional matrix 36 and the deflector rod 37, so that the wire configuration illustrated in FIG. 9 is formed. In this position, the wire guide 45 is moved with the wire guide cannula 46 through the second wire holding device 40, so that the winding wire 53 is now also clamped in the second wire holding device 40. In this manner, a further winding wire end 64 is formed between the deflector rod 37 and the second wire holding device 40 in the same manner as between the deflector rod 37 and the first wire holding device 39.

As is also clear from the illustration according to FIG. 9, overlap regions 65, 66 between the winding wire 53 and the connecting surfaces 57, 58 of the chip unit 59 are produced as a result of the alignment of the winding wire regions 55 and 56 by means of the additional matrix 36. As a result of the fact that the winding wire regions 55, 56, which are defined in their alignment, extend far beyond the surface of the chip unit 59, there is no great need for precision positioning of the chip unit 59 along the longitudinal extension axis 61 of the additional matrix 36 in order to form overlap regions 65, 66 between the winding wire 53 and the connecting surfaces 57, 58 of the chip unit 59.

Proceeding from the coil configuration 67 illustrated in FIG. 9 comprising the coil element 54 as one winding wire region and further winding wire regions 55, 56, in order to construct the coil arrangement 52 illustrated in FIG. 10 as a transponder unit comprising the coil element 54 and the chip unit 59, a contacting of the winding wire regions 55, 56 with the connecting surfaces 57, 58 of the chip unit 59 is effected in the winding tool 28.

In order to remove the winding wire ends 63, 64 cut using a suitable device in the region of the wire holding devices 39, 40 and the deflector rod 37, a wire gripping device is used, which is not illustrated in further detail here and draws the winding wire regions 55 and 56 into the gripping aperture 38 and grasps the winding wire ends 63, 64 prior to cutting and following cutting removes said winding wire ends 63, 64 from the matrix surface 26 of the basic matrix 21. The finished coil arrangement 52 illustrated in FIG. 10 is then removed from the winding tool 28, for example by lowering the basic matrix 21 in the matrix support 20.

The manufacture of the coil arrangement 52 (FIG. 10) explained above with reference to FIGS. 1 to 9 represents only one possibility of applying the method according to the invention. The winding tool 28 illustrated in FIGS. 1 to 9 can also be used in an essentially unmodified form for the manufacture of a coil arrangement 68 illustrated in FIG. 11.

Figure 11:
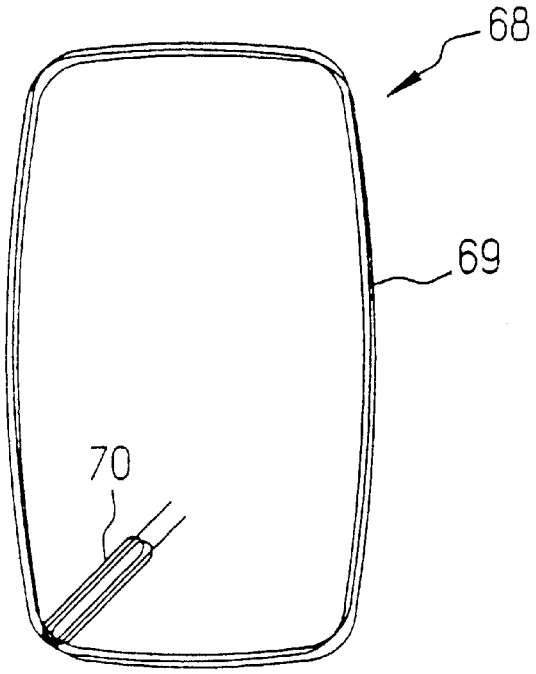
FIG. 11 shows a second coil arrangement manufactured on the winding tool according to FIG. 1.

FIG. 11 shows the coil arrangement 68, which comprises two coil elements 69 and 70, which are constructed using the method described above in a method variant so as to extend continuously into one another. In this respect, in contrast to the manufacture of the coil arrangement 52 shown in FIG. 10, the winding process of the winding tool 28 is continued following the formation of the second winding wire region 56 on the additional matrix 36 with the winding tool 28 open, so that in addition to the coil element 69 formed on the basic matrix 21, the further coil element 70 with any desired number of windings can be formed on the additional matrix 36.

What is claimed is:

1. Winding tool for manufacturing a coil arrangement, the tool comprising:

a matrix support;

a matrix arranged on said matrix support, said matrix including a basic matrix with a matrix surface and an additional matrix arranged on said matrix surface;

a holding arrangement arranged at a circumference of said matrix on said matrix support, said holding arrangement including a plurality of wire holding devices for holding winding wire ends;

a brace arranged opposite said matrix support and movable with respect to said basic matrix;

a wire guide for supplying wire to said matrix support, said additional matrix interactive with said holding arrangement and said wire guide to form a coil with a plurality of turns.

2. Winding tool according to claim 1, wherein:

a chip holding device is arranged on said basic matrix for holding a chip unit with a plurality of connecting surfaces in a predetermined position;

said additional matrix includes a plurality of matrix elements arranged on either side of said chip holding device, said matrix elements being arranged and constructed to create winding wire regions extending along a winding circumference of said additional matrix, where said winding wire regions overlap with said connecting surfaces of a chip unit arranged in said chip holding device.

3. Winding tool according to claim 2, wherein:

matrix elements of said additional matrix are constructed as cylinder rods.

4. Winding tool according to claim 1, wherein:

said additional matrix includes a plurality of matrix elements a wire deflecting device is arranged adjacent to one of said matrix elements of said additional matrix;

an intermediate space between said one matrix element and said wire deflecting device forms an engagement space for a wire gripping device.

5. Winding tool according to claim 1, wherein:

a wire deflecting device is arranged adjacent to one of said matrix elements of said additional matrix;

an intermediate space between said one matrix element and said wire deflecting device forms an engagement space for a wire gripping device.

6. Winding tool according to claim 2, wherein:

a wire deflecting device is arranged adjacent to one of said matrix elements of said additional matrix;

an intermediate space between said one matrix element and said wire deflecting device forms an engagement space for a wire gripping device.

7. The winding tool in accordance with claim 1, wherein:

said additional matrix includes a plurality of matrix rods, one of said matrix rods being spaced from said basic matrix.

8. The winding tool in accordance with claim 1, further comprising:

a deflector rod arranged adjacent said basic matrix and deflecting a wire from said basic coil to said additional matrix.

9. The winding tool in accordance with claim 1, wherein:

said additional matrix includes a plurality of matrix rods spaced from said basic matrix;

a deflector rod is arranged adjacent said basic matrix and deflects a wire from said basic matrix to one of said matrix rods.

10. The winding tool in accordance with claim 1, wherein:

said additional matrix interacts with said holding arrangement and said wire guide to move the wire around an outside of said additional matrix.

11. A winding tool for manufacturing a coil arrangement, the tool comprising:

a matrix support;

a first winding matrix arranged on said matrix support for forming a first coil of wire, said first matrix including a matrix surface;

a second winding matrix arranged on said matrix surface for forming a second coil of wire;

a holding arrangement arranged at a circumference of said first matrix on said matrix support, said holding arrangement including a plurality of wire holding devices for holding wire ends;

a brace arranged opposite said matrix support and movable with respect to said basic matrix.

12. The winding tool in accordance with claim 11, wherein:

a wire guide is provided for suppling wire to said matrix support;

said second matrix interacts with said holding arrangement and said wire guide to form said second coil with a plurality of turns.

13. The winding tool in accordance with claim 11, wherein:

said second matrix includes a plurality of matrix rods, one of said matrix rods being spaced from said first matrix.

14. The winding tool in accordance with claim 11, wherein:

said second coil is arranged inside said first coil and only one portion of said second coil is wound adjacent said first coil.

15. The winding tool in accordance with claim 11, further comprising:

a deflector rod arranged adjacent said first matrix and deflecting a wire from said first coil to said second matrix.

16. The winding tool in accordance with claim 11, wherein:

said second matrix includes a plurality of matrix rods spaced from said first matrix;

a deflector rod is arranged adjacent said first matrix and deflects a wire from said first coil to one of said matrix rods.

17. The winding tool in accordance with claim 11, wherein:

a wire guide is provided for suppling wire to said matrix support;

said second matrix interacts with said holding arrangement and said wire guide to move the wire around an outside of said second matrix.

* * * * *